United States Patent [19]

Olin et al.

[11] Patent Number: 4,928,326

[45] Date of Patent: May 29, 1990

[54] VACUUM SEWER ARRANGEMENT

[75] Inventors: Henry Olin, Espoo; Gunnar Lindroos, Helsinki, both of Finland; Sven Oldfelt, Vaxholm, Sweden

[73] Assignee: Oy Wärtsilä Ab, Helsinki, Finland

[21] Appl. No.: 177,070

[22] Filed: Apr. 4, 1988

[30] Foreign Application Priority Data

Apr. 6, 1987 [FI] Finland ..... 871491

[51] Int. Cl.[5] ..... E03D 5/00; E03D 9/14

[52] U.S. Cl. ..... 4/300; 4/234

[58] Field of Search ..... 4/300, 431, 432, 433, 4/434, 316, 317, 329, 332, 237, 234; 137/606, 607

[56] References Cited

U.S. PATENT DOCUMENTS

| | | | |
|---|---|---|---|
| 3,482,267 | 12/1969 | Liljendahl | 4/431 |
| 3,593,349 | 7/1971 | Bungo | 4/237 |
| 3,651,524 | 3/1972 | Bengtsson et al. | 4/431 |
| 3,720,962 | 3/1973 | Harrah | 4/431 |
| 3,807,431 | 4/1974 | Svanteson | 137/578 |
| 3,984,080 | 10/1976 | Varis et al. | 251/5 |
| 3,998,736 | 12/1976 | Greenleaf, Jr. | 137/396 |
| 4,063,315 | 12/1977 | Carolan et al. | 4/316 |
| 4,171,853 | 10/1979 | Cleaver et al. | 251/61.5 |
| 4,232,409 | 11/1980 | Van Pham | 4/431 |
| 4,357,719 | 11/1982 | Badger et al. | 4/316 |
| 4,376,444 | 3/1983 | Michael | 137/1 |
| 4,713,847 | 12/1987 | Oldfelt et al. | 4/431 |
| 4,791,688 | 12/1988 | Krishnakumar | 4/319 |
| 4,791,949 | 12/1988 | Tank | 137/1 |

OTHER PUBLICATIONS

Swedish Patent Application 8207173-9, 6/16/84.

"Motorship" magazine, 10/89 EVAC "The Quiet Mush" advertisement.

*Primary Examiner*—Henry J. Recla

*Assistant Examiner*—Edward C. Donovan

*Attorney, Agent, or Firm*—Dellett, Smith-Hill & Bedell

[57] ABSTRACT

A vacuum sewer arrangement comprises a valve controlled air inlet duct to let air into the vacuum sewer at a position downstream of the sewer valve. The sewer valve can then be closed immediately after the sewage has passed into the vacuum sewer, because the air required for the sewage transport is received form the air inlet duct. hence, the amount of air that flows into the sewer through the sewer valve when the sewer valve opens is small, and when the sewer valve is closed, air flows through the air inlet duct into the sewer, which reduces the pressure difference acting on the sewer valve. These measures tend to considerably reduce the noise level. In the case of a vacuum toilet sewer arrangement, the noise level can be further reduced by providing the toilet bowl with a lid forming a substantially airight and soundproof closure at the top of the bowl. The volume of air contained in the bowl may be too small for proper discharge of the sewage, in which case additional air can be provided through a separate tube. This tube may be connected to the air inlet duct upstream of its valve.

17 Claims, 3 Drawing Sheets

19
20
5
6
V
14
23
15
16
17
18
11
8
7
12
13
4
10
9
1
V
3
2

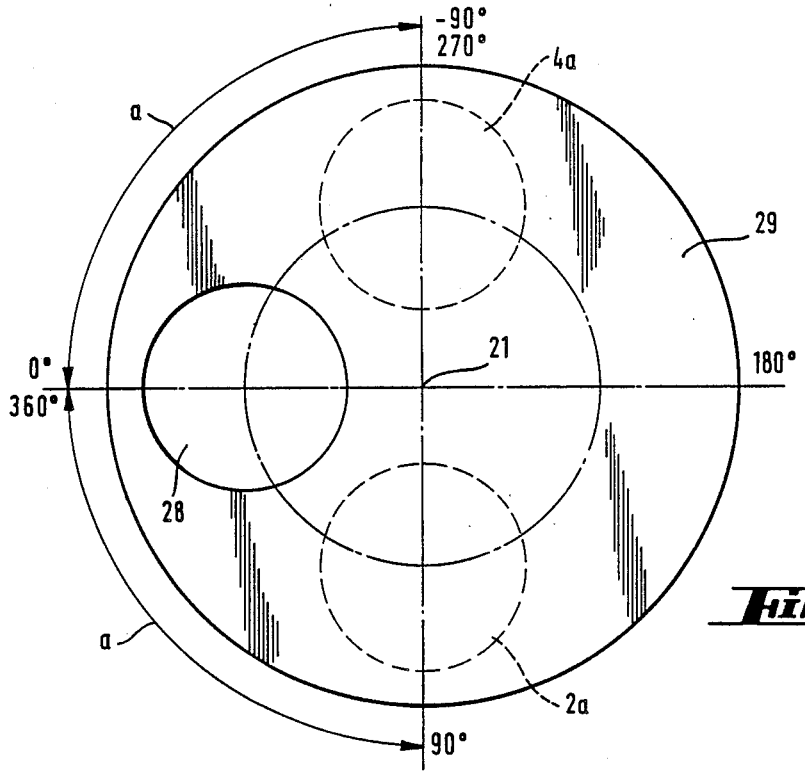
Fig. 2
Fig. 3A
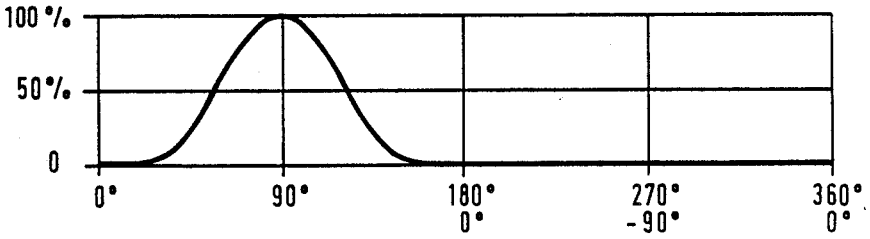
Fig. 3B
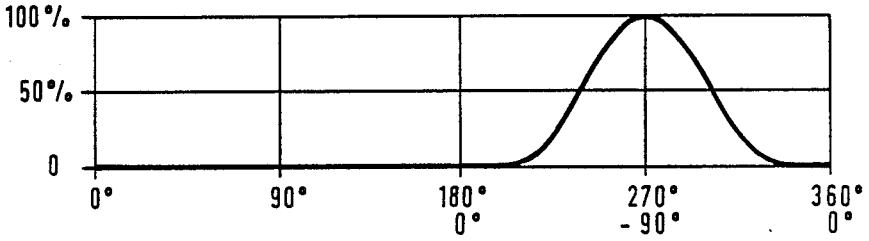

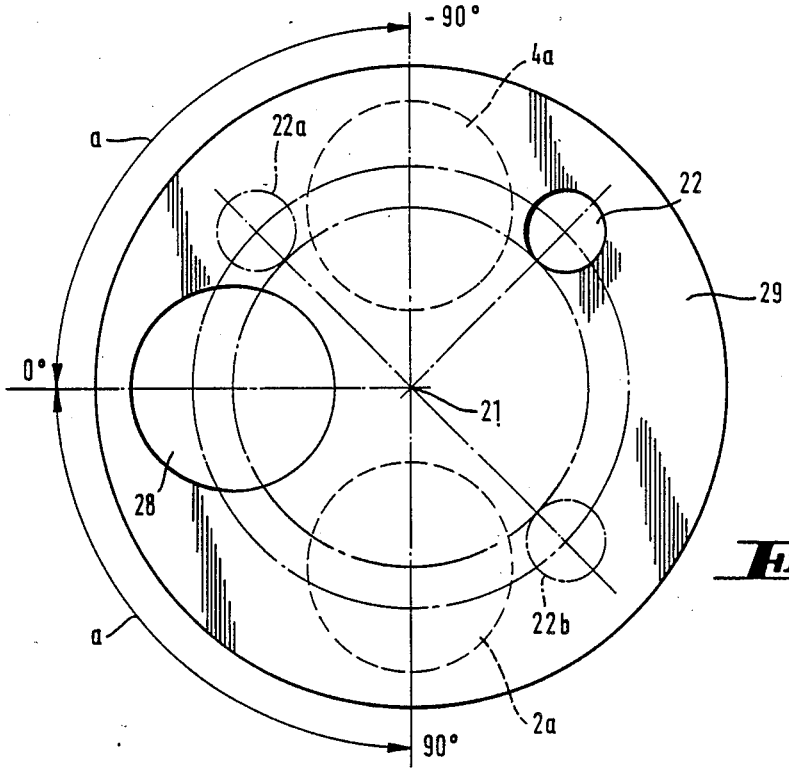
Fig. 4
Fig. 5A
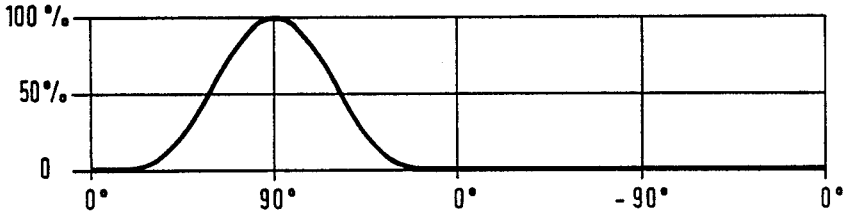
Fig. 5B
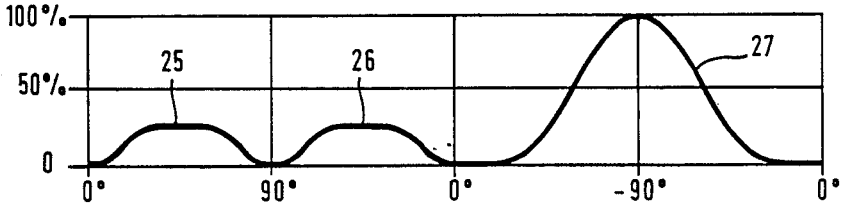

VACUUM SEWER ARRANGEMENT

BACKGROUND OF THE INVENTION

The invention relates to a vacuum sewer arrangement.

One great problem related to vacuum sewer arrangements operating with a pressure difference of about ½ atmosphere is the high noise level. The noise is produced when the sewer valve opens and closes and when air is sucked into the open sewer. The vacuum sewer technique requires that a rather large amount of air flows into the sewer after the sewage. These operations produce considerable pressure variations and they give rise to noise.

SUMMARY OF THE INVENTION

The invention may be used to provide a vacuum sewer arrangement, which, in particular when used as a toilet sewer arrangement, considerably reduces the noise level. The noise level of a vacuum toilet sewer arrangement in accordance with the invention can be reduced to approximately that of a conventional gravity toilet, that is, to a level considerably below the noise level of a conventional vacuum toilet.

According to the invention, a valve controlled air inlet duct is employed to let in air to the vacuum sewer at a position downstream of the sewer valve. Due to this, the sewer valve can be closed immediately after the sewage has passed into the vacuum sewer, because the air required for the sewage transport is received from the air inlet duct. Hence, the amount of air that flows into the sewer through the sewer valve when the sewer valve opens is small, and when the sewer valve is closed, air flows through the air inlet duct into the sewer, which reduces the pressure difference acting on the sewer valve. These measures tend to considerably reduce the noise level. The air inlet duct can be made sound insulated and can be provided with a muffler. Then air flowing through the air inlet duct will not cause a disturbing level of noise. The noise level of a vacuum toilet sewer arrangement according to the invention can be further reduced by providing the toilet bowl with a lid forming a substantially airtight and sound-proof closure at the top of the bowl. The volume of air contained in the bowl may be too small for proper discharge of the sewage, in which case additional air can be provided through a separate tube. This tube may be connected to the air inlet duct upstream of its valve. In a vacuum toilet sewer arrangement of this structure, the lowest noise level is achieved.

By connecting the air inlet duct to the vacuum sewer, immediately downstream of the sewer valve or even through the sewer valve, the amount of air flowing from the sewage providing unit into the sewer can be reduced very much, which tends to reduce the noise level to a minimum.

Conventionally, the sewer valve of a vacuum sewer arrangement is operated by using the vacuum present in the vacuum sewer. In an arrangement according to the invention the same vacuum can be used also for operating the valve controlling the air inlet duct. This gives a simple and reliable structure. Preferably, valves of the same or substantially the same structure are used both as sewer valve and as air inlet valve. This simplifies production and spare part service, because only one valve type is needed.

Operation of the air inlet valve can take place in the same manner as the operation of the sewer valve, but normally there should be a small time delay. A suitable time delay can be obtained by supplying the pressure difference needed for operating the sewer valve also to the air inlet valve, but through a throttled tube, whereby the throttling provides the required time delay in activating the air inlet valve.

The vacuum available from the sewer may not be sufficient to operate two valves, particularly because there is a pressure rise in the vacuum sewer when the sewer valve opens. Operating difficulties due to insufficient vacuum can easily be avoided by arranging a vacuum accumulator between the vacuum sewer and the control device of the sewer valve. A check valve may be arranged between the vacuum accumulator and the sewer, so that a pressure rise in the sewer is unable to have any influence on the pressure in the vacuum accumulator.

In some vacuum sewer arrangements, use of a mechanically or electrically operated sewer valve is preferred. This is the case in an aircraft vacuum toilet sewer arrangement, where the amount of flush water is extremely small, only about 0.2 liter or less. In this case, the sewer valve must function with a very high accuracy. For this type of vacuum toilet, U.S. Pat. No. 4,713,847 suggests the use of a valve in which the closure member is an apertured rotatable disc. Such a rotatable valve disc can be driven by a motor, a solenoid and/or by a mechanical power transmission. Further, this type of valve, as well as many other valve types, can easily be so designed that the valve works as a three-way valve, which in one operating position connects the air inlet duct to the vacuum sewer and in another operating position connects the sewage providing unit to the vacuum sewer. It is also feasible to provide a rotatable valve closure member with two apertures, of which one functions as a flow aperture of the sewer valve and the other functions as a flow aperture of the air inlet valve.

The invention makes it possible to considerably reduce the time during which the sewer valve must be kept open. Normally about 3 seconds is sufficient for keeping the valve open, but even shorter times are possible in a well trimmed device. A suitable valve control system may be so arranged that the sewer valve opens about 1 second before the air inlet valve, which in turn closes 2 to 3 seconds after the sewer valve closes. In the case where a very strong vacuum (=very low absolute pressure) is used in the sewer in order to provide for an efficient sewage transport or for other reasons, the pressure difference acting across the sewer valve might be unfavorably high. In a vacuum sewer arrangement according to the invention, air may be provided to the sewer through the air inlet duct also during the opening phase of the sewer valve, for reducing the pressure difference across the sewer valve.

If a toilet bowl of a vacuum sewer arrangement according to the invention is provided with a tight lid for minimizing the noise level, it is favorable that the lid be of relatively thick sound insulating material. Various plastic materials, sandwich structures etc. are well suitable for this purpose. Providing additional air to the toilet bowl is then advisable.

In this specification and in the claims "vacuum" means "partial vacuum" of a magnitude suitable for use in a vacuum sewer system. Conventionally, the vacuum in such a system is about ½ atmosphere, or about 38 cm Hg.

BRIEF DESCRIPTION OF THE DRAWINGS

The invention will now be described in greater detail with reference to the accompanying drawing, in which FIG. 1 schematically shows an embodiment of the invention with a vacuum operated sewer valve, FIG. 2 schematically shows a combined valve device according to the invention, FIG. 3A and 3B show function diagrams of a valve according to FIG. 2, FIG. 4 shows another embodiment of the valve according to FIG. 2, FIGS. 5A and 5B show function diagrams of a valve according to FIG. 4.

DETAILED DESCRIPTION

Figure 1:
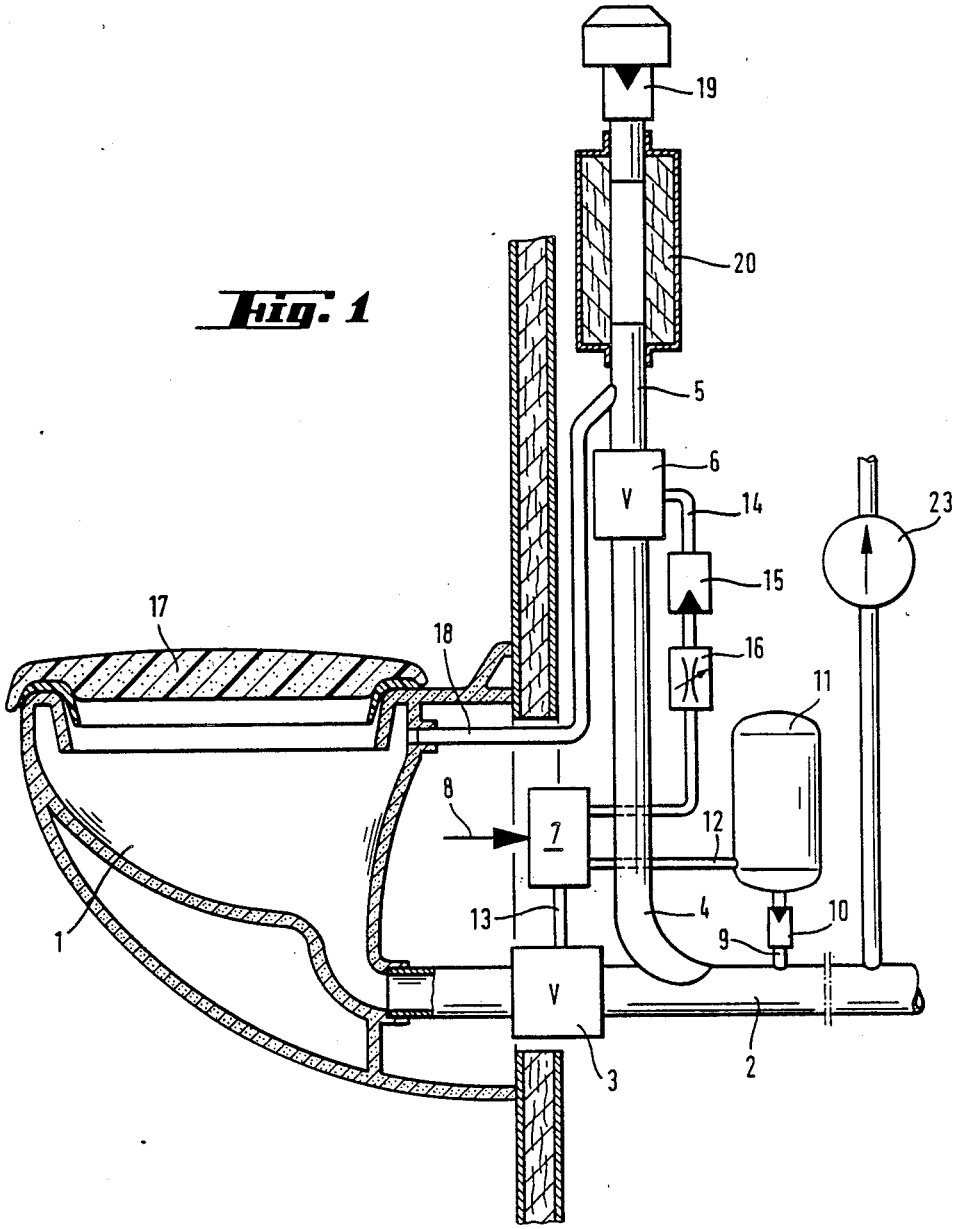

FIG. 1 illustrates a toilet bowl 1 and a sewer 2 connected to the toilet bowl by a sewer valve assembly 3. The interior space of the sewer 2 is maintained under vacuum, which is provided as known per se, by a vacuum pump 23. This pump is usually connected to the downstream end of the sewer 2, or may be connected to a sewage collecting tank (not shown), which also is maintained under vacuum. The sewer valve assembly 3 includes a sewer valve proper and a sewer valve operating device which opens the sewer valve by using vacuum. Various valve assemblies of this type are described in U.S. Pat. Nos. 3,482,267, 3,807,431, 3,984,080 and 4,376,444. Since suitable vacuum operated valves are known, the structure of the sewer valve assembly will not be explained here.

An air inlet duct 4 is connected to the sewer 2 immediately downstream of the sewer valve assemby 3. An air inlet valve assembly 6, which in the embodiment shown in FIG. 1 is of the same structure as the sewer valve assembly 3, and accordingly includes an operating device which opens an air inlet valve in response to vacuum, is connected to the air inlet duct 4. The upstream side 5 of the valve assembly 6 is connected through a check valve 19 and a muffler 20 to the ambient atmosphere. A control device 7, which controls both valve assemblies 3 and 6, is activated by a function impulse 8. Such an impulse may originate from a push button operated by the user of the toilet and may be transmitted, for instance mechanically, in the form of a pressure impulse, or electrically, to the control device 7. The function impulse 8 may be dependent on, for instance the closing of a lid 17 of the toilet bowl or on other factors which are relevant to controlling the flushing of the toilet. Since these factors also are well known in the art, neither the creating of a function impulse nor the manner of operation of the control device 7 will be explained here.

A general principle in a vacuum sewer arrangement is that the sewer valve should function only when there is sufficient vacuum in the sewer for effective transport of sewage. In order to achieve this, the vacuum required to open the sewer valve is taken from the sewer 2 or from another point of the vacuum system. If the available vacuum is too weak for effective transport of sewage, the sewer valve will not open. In the embodiment of FIG. 1 the vacuum required for the operation of the sewer valve is communicated from the sewer 2 to the control device 7 through a tube 9, a check valve 10 and a tube 12. A vacuum accumulator 11 may be connected between the valve 10 and the tube 12. Upon receiving a function impulse 8, the control device 7 transmits vacuum received from the sewer 2 and/or from the vacuum accumulator 11 through a tube 13 to the sewer valve operating device, which then opens the sewer valve. At the same time the control device 7 transmits vacuum through a tube 14 towards the air inlet valve assembly 6, and the air inlet valve opens when its operating device comes under the influence of vacuum.

Transmitting vacuum to a device means in practice that the atmospheric pressure in the device is allowed to disperse into a space where the pressure is lower. Hence, when the vacuum is connected to the operating device of the valve assembly 6, air contained in the operating device flows away through the tube 14. Since it is usually desirable that the air inlet valve opens slightly later than the sewer valve, the air flow from the operating device of the valve assembly 6 is slowed down. This can be obtained by means of a preferably adjustable throttling device 16. The tube 14 may also be provided with a check valve 15, which does not provide a quite tight closure, but allows also in its closed position a small throttled flow of air from the valve assembly 6 to the control device 7. This provides different throttling in the tube 14 in different flow directions.

The use of a vacuum accumulator 11 is not always necessary. The object of the vacuum accumulator is to insure that a sufficient amount of vacuum is available for operating the sewer and air inlet valves. When the sewer valve opens, the pressure in the sewer 2 rises. The check valve 10 is provided in order to prevent this higher pressure from reaching the tube 12 and reducing the vacuum present in the operating devices of the valve assemblies 3 and 6. The vacuum accumulator 11 also enlarges the volume under vacuum, so that there will certainly be enough vacuum for operating both the sewer valve and the air inlet valve.

It is, of course, also possible for the sewer valve and the air inlet valve to be operated electrically, for instance by means of a motor, a solenoid or the like.

The basic structure of an arrangement according to the invention requires that air is led through the air inlet duct 4 to the vacuum sewer 2 when the sewage providing unit 1 is to be emptied. This substantially reduces the noise level, but nevertheless, the noise level might be unpleasantly high. Hence, letting in air by way of an air inlet duct is not always sufficient to reduce the noise level to an acceptable value. Additional measures might be necessary for improving the technical effect of the basic embodiment of the invention. A suitable additional measure is to provide the toilet bowl or the corresponding sewage providing unit with an airtight lid 17. Such a lid should be made relatively sound-proof. Opening of the sewer valve can, as known per se, easily be made dependent on the closing of the lid 17, so that the valve opens only when the lid is closed.

Using an airtight lid in a vacuum toilet may result in the amount of air present in the toilet bowl 1 being too small for efficient flushing. This can be cured by connecting an air tube 18 to the bowl 1. Air is led into the bowl through the tube 18 without any substantial noise. The air supply for the tube 18 can be taken from any place, for instance, from outside the toilet compartment. Since the air inlet duct 4 is already present, the best solution is usually to supply air for the toilet bowl from this duct. In that case the tube 18 is connected to the air inlet duct 4 at a point upstream of the air inlet valve assembly 6.

FIG. 2 shows a valve closure member that is formed by an apertured rotatable disc 29. By rotating the disc 29 through 90 degrees counter-clockwise around its center 21, the aperture 28 of the disc is brought into line with a sewer duct 2a between the sewage providing unit and the vacuum sewer, whereby the sewer duct is fully opened. From this position, rotation of the disc 29 can be either continued in a counter-clockwise direction or reversed. When the disc 29 has been rotated in either direction 180 degrees from the open position of the sewer valve, the aperthure 28 is in line with an air inlet duct 4a, which is then fully opened.

FIG. 3A shows the opening and closing of the sewer duct 2a as a function of the turning angle a of the disc 29, and FIG. 3B correspondingly shows the opening and closing of the air inlet duct 4a. The opening percentage of the ducts 2a and 4a is shown on the vertical axis of both FIGS. 3A and 3B. If it is desired that the air inlet duct 4a should start to open before the sewer duct 2a is fully closed, the position of the duct 4a may be adjusted so that it is closer to the duct 2a at the right side of FIG. 2 along the moving path of the aperture 28. This, however, requires that the disc 29 be rotated only counter-clockwise.

In the embodiment according to FIG. 4, the disc 29 also has a smaller aperture 22. When the larger haperture 28 moves towards the sewer duct 2a, the smaller aperture 22 passes over the air inlet duct 4a, whereby this duct is partly opened as shown by the curve 25 in FIG. 5B. When the aperture 28 is in line with the sewer duct 2a, the smaller aperture 22 is at the position 22a, and therefore the duct 4a is closed. The disc 29 is then rotated in the opposite direction in order to close the sewer duct 2a. At the same time, the air inlet duct is again partly opened as shown by the curve 26 in FIG. 5B. By continuing rotation of the disc 29 in a clockwise direction beyond its initial position, the aperture 28 is brought into line with the air inlet duct 4a, which is then completely open as shown by the left side half of the curve 27 in FIG. 5B. The aperture 22 is then at the position 22b. By rotating the disc 29 in a counter-clockwise direction back to its initial position the air inlet duct is closed as shown by the right side half of the curve 27 in FIG. 5B. In the embodiment according to FIG. 4 the air inlet duct opens partly in the initial phase of the opening of the sewer duct (curve 25) as well as in the end phase of its closing (curve 26). The mutual relative position of the curves of FIGS. 5A and 5B can be changed by changing the position of the ducts 2a and 4a and/or the position of the disc apertures 28 and 22. The opening percentages of the ducts 2a and 4a are shown in FIGS. 5A and 5B in the same manner as in FIGS. 3A and 3B.

The invention is not limited to the embodiments shown, but several modifications of the invention are feasible within the scope of the attached claims.

We claim:

1. A vacuum sewer arrangement comprising:
a sewage providing unit,
a sewer defining an interior space,
means for establishing, in the interior space of the sewer, a vacuum sufficient for obtaining effective sewage transport,
a normally closed sewer valve connected between the sewage providing unit and the sewer,
a first valve operating device coupled to the sewer valve for opening the sewer valve, the first valve operating device being operative in response to vacuum and being connectable to the sewer,
an air inlet duct for letting air into the sewer, separately from the sewage providing unit,
an air inlet valve for controlling flow of air through the air inlet duct into the vacuum sewer,
a second valve operating device coupled to the air inlet valve for opening the air inlet valve, the second valve operating device being operative in response to vacuum and being connectable to the vacuum sewer, and
a valve control device through which vacuum is connected to both the first and second valve operating devices, the valve control device being connected to the second valve operating device by means of a throttled pneumatic tube.

2. An arrangement according to claim 1, in which the air inlet valve is at least substantially of the same structure as the sewer valve.

3. An arrangement according to claim 1, comprising a vacuum accumulator connected between the sewer and the first and second valve operating devices and a check valve connected between the vacuum accumulator and the sewer.

4. An arrangement according to claim 1, in which the sewage providing unit is a toilet bowl, which is provided with a closable lid.

5. An arrangement according to claim 4, in which the lid provides a substantially airtight closure.

6. An arrangement according to claim 5, in which the toilet bowl is provided with a tube for providing air to the bowl when the lid of the bowl is closed.

7. An arrangment according to claim 6, in which the tube for providing air to the toilet bowl is connected to the air inlet duct upstream of the air inlet valve.

8. An arrangement according to claim 5, wherein the lid is made of sound insulating material.

9. A vacuum sewer arrangement comprising:
a toilet bowl having a closable lid that provides a substantially airtight closure of the toilet bowl,
a sewer defining an interior space,
means for establishing, in the interior space of the sewer, a vacuum sufficient for obtaining effective sewage transport,
a normally closed sewer valve connected between the toilet bowl unit and the sewer,
a control device for controlling operation of the sewer valve,
an air inlet duct for letting air into the sewer separately from the toilet bowl unit,
an air inlet valve for controlling flow of air through the air inlet duct into the vacuum sewer,
a tube for providing air to the toilet bowl when the lid of the bowl is closed, the tube being connected to the air inlet duct upstream of the air inlet valve, and
means for controlling operation of the air inlet valve so that it opens in timed relation with the opening of the sewer valve and closes after the closing of the sewer valve.

10. An arrangement according to claim 9, in which the air inlet valve is at least substantially of the same structure as the sewer valve.

11. An arrangement according to claim 9, comprising a first valve operating device coupled to the sewer valve for opening the sewer valve, and a second valve operating device coupled to the air inlet valve for opening the air inlet valve, the two valve operating devices being operative in response to vacuum and being connectable to the sewer.

12. An arrangement according to claim 11, comprising a vacuum accumulator connected between the sewer and the first and second valve operating devices and a check valve connected between the vacuum accumulator and the sewer.

13. An arrangement according to claim 9, in which the sewer valve and the air inlet valve are formed by an integrated device, having a first functional position connecting the toilet bowl to the sewer and a second functional position connecting the air inlet duct to the sewer.

14. An arrangement according to claim 13, in which the integrated sewer and air inlet valve has a closure member in the form of a rotatable disc formed with at least one aperture, wherein said one aperture is movable to a first position providing open connection between the toilet bowl and the sewer and to a second position providing open connection between the air inlet duct and the sewer.

15. An arrangement according to claim 14, in which the disc has at least two apertures, one of which is movable to a position providing open connection between the air inlet duct and the sewer.

16. An arrangement according to claim 9, wherein the lid is made of sound insulating material.

17. An arrangement according to claim 9, wherein the means for controlling operation of the air inlet valve control such operation so that the air inlet valve opens after the sewer valve opens and before the sewer valve closes.

* * * * *